United States Patent [19]

Schreiber

[11] 4,154,134

[45] May 15, 1979

[54] CHORD PLAYING ATTACHMENT FOR STRINGED INSTRUMENTS

[76] Inventor: Herbert Schreiber, Belvederestrasse 63, 8968 Mutschellen, Switzerland

[21] Appl. No.: 759,409

[22] Filed: Jan. 14, 1977

[30] Foreign Application Priority Data

Jan. 22, 1976 [CH] Switzerland ..... 862/76

[51] Int. Cl.[2] ..... G10D 3/04; G10D 3/08

[52] U.S. Cl. ..... 84/317; 84/318

[58] Field of Search ..... 84/315–317, 84/318

[56] References Cited

U.S. PATENT DOCUMENTS

| | | | |
|---|---|---|---|
| 1,094,038 | 4/1914 | Weaver et al. | 84/317 |
| 1,219,884 | 3/1917 | Thingstad | 84/317 |
| 3,422,717 | 1/1969 | Roussel | 84/317 |
| 3,680,427 | 8/1972 | Valentino | 84/318 |
| 3,834,267 | 9/1974 | Shubb et al. | 84/318 |
| 3,995,523 | 12/1976 | Clarke | 84/317 |

FOREIGN PATENT DOCUMENTS

| | | | |
|---|---|---|---|
| 80952 | 6/1963 | France | 84/317 |

*Primary Examiner*—Lawrence R. Franklin
*Attorney, Agent, or Firm*—Werner W. Kleeman

[57] ABSTRACT

A chord playing attachment for stringed instruments, such as guitars and the like, wherein combinations of string depressors are pressed down on the strings to produce a chord. The string depressors are connected with a spring action to a component which is attached to the instrument. This component serves the dual function of an attachment base for the string depressors as well as acting as a capo dastro.

5 Claims, 14 Drawing Figures

CHORD PLAYING ATTACHMENT FOR STRINGED INSTRUMENTS

BACKGROUND OF THE INVENTION

The present invention relates to a new and improved chord playing attachment for stringed instruments, such as guitars and the like, where combinations of string depressors are pressed down or depressed in such a manner as to produce a chord.

The previously known chord playing attachments have relatively complicated designs which makes their manufacture very expensive. Furthermore, these attachments generally are associated with the disadvantage that they can be mounted at just one fixed key position and that it is impossible to play both on the finger keys of the attachment and on the uncovered fret positions at the same time. In practice, these attachments have hardly ever been used.

SUMMARY OF THE INVENTION

Hence, it is a primary object of the present invention to provide a chord playing attachment for stringed instruments which eliminates the aforementioned disadvantages of the prior art constructions.

Another object of the present invention aims at the provision of a new and improved construction of chord playing attachment which is both practical to manufacture and use, for instance, it can be injection molded from plastic and can be attached to any desired key position of the guitar or other stringed instrument.

Still a further significant object of the present invention is to provide a chord playing attachment for stringed instruments which is constructed such that it is possible to fret the strings in front of the attachment with the fingers in the usual way, thus permitting even more chords to be produced.

Now in order to implement these and still further objects of the invention which will become more readily apparent as the description proceeds, the chord playing attachment for string instruments constructed according to the invention is manifested by the features that the string depressors are connected with a spring action to a component or element which can be mounted on the neck of the instrument. This component acts both as an attachment base for the string depressors as well as a capo dastro. The string depressors can be mounted on individual spring levers which can be pressed down in combinations with finger keys to produce a chord. They can also be combined together on a single plate and in this case they are collectively depressed as a single unit. Both these modes of construction may be employed together in the same device to great advantage.

If the chord playing attachment is to be set at any desired key position to permit different keys to be played, it is advantageous to mount the string depressors to the attachment base with a slidable connection. To simplify the construction, the individual string depressors may be attached to a top plate which can be slid back and forth over the attachment base. Only those string depressors that act on the same or adjacent key positions should be mounted to the same top plate. If more than one top plate is required these can be mounted one over the other or one behind the other. The string depressors that act upon the fret adjacent to the capo dastro can be connected non slidably to the attachment base.

For many chord groups, the construction can be considerably simplified if the capo dastro is so designed that instead of all the strings being depressed as usual at one fret, different strings can be depressed at different frets.

The simplest designs are obtained by connecting the spring levers or plates, which hold the string depressors, directly to the top plate by means of flat springs. However, another alternative arrangement is to attach the levers or plates to the top plate by means of joints or hinges and to support them with the aid of springs. With both constructions the position of the spring levers can be limited in their raised positions by means of a stop the position of which may be adjusted with a screw or equivalent structure, thereby making it possible to set the distance between the string depressors and the strings to the optimum value.

The chords and designations of the key positions that are described and referred to hereinafter relate by way of example to a guitar that is tuned in the usual way to the notes E A d g b e'. Furthermore, the chord playing attachment is assumed to be placed on the finger board in such a way that the part of the capo dastro that acts upon the lowest fret is located at the first fret position.

It has been found that, for optimum performance, the chord playing attachment has the simplest design when it includes at least three consecutive major chords from the series $D^{\flat}\ A^{\flat}\ E^{\flat}\ B^{\flat}\ F\ C$ where the last chord of this series could also be replaced by its seventh chord. A most advantageous design is obtained if the capo dastro acts upon two adjacent key positions and the chord playing attachment includes the chords from at least one of the groups $E^{\flat}\ B^{\flat}\ F^{7}$ and especially $B^{\flat}F$ and $C^{7}$.

The conventional means that are used to fasten the capo dastro to the neck of the guitar also can be employed to fasten the chord playing attachment to the guitar. For example, belts, elastic bands, or clamps could be fastened to the attachment base.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENT

In the description to follow there will be considered, by way of example, various embodiments of chord playing attachments designed according to the invention. For convenience these different embodiments will be referred to hereinafter as models 1, 2, 3*a*, 3*b*, 4, 5, 6, 7 and 8.

Model 1

Figure 1:
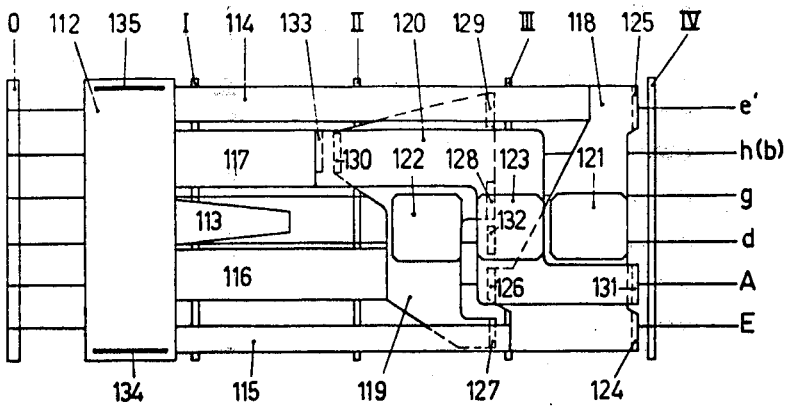
FIG. 1 is a top plan view of a first exemplary embodiment of chord playing attachment constructed according to the invention.
Figure 2:
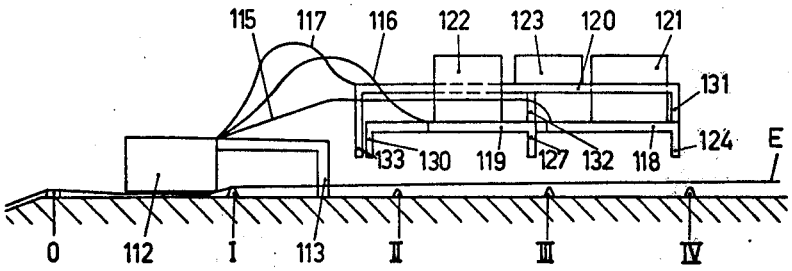
FIG. 2 is a side view thereof.

FIG. 1 shows a top view and FIG. 2 shows a side view of this first embodiment of chord playing attachment. The signs E, A, d, g, b, and e′ in the figures refer to the strings E, A, d, g, b, and e′ which pass over the nut O and terminate in the tuning peg members. The reference characters I, II, III, and IV refer to the frets of the first, second, third and fourth key positions. A component or element providing an attachment base 112, which also acts as a capo dastro, rests on the finger board in fret position I and is supported by a foot 113 which passes between the strings g and d. The two springs 114 and 115 that are connected to the attachment base 112 carry the chord plate 118 with its associated finger key 121 and the string depressors 124, 125 and 126 for an $A^{\flat}$ major chord. Spring 116 carries the chord plate 119 with finger key 122 and string depressors 127, 128, 129 and 130 for an $E^{\flat 7}$ chord. Spring 117 carries the chord plate 120 with its finger key 123 and the spring depressors 131, 132, and 133 for a $D^{\flat}$ major chord. Chord plate 120 is located high enough over the chord plates 118 and 119 so that the free space between the plates can accommodate at least the distance of one key stroke. The chord playing attachment can be fastened to the neck of the guitar or the like in the same way as a conventional capo dastro, e.g. by means of a belt that is fastened to the two slits 134 and 135 or by a clamping arrangement that fits around the neck of the guitar.

Model 2

Figure 3:
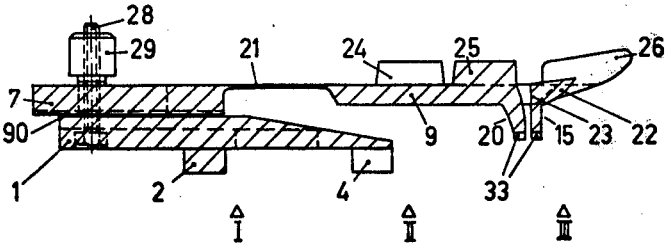
FIG. 3 is a sectional view of a second embodiment of chord playing attachment.
Figure 4:
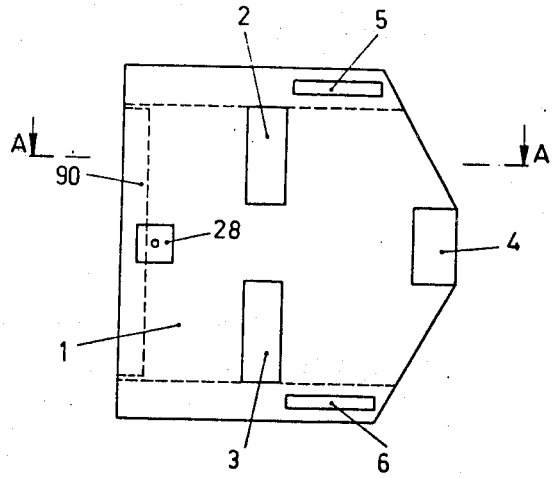
FIG. 4 is a bottom view of the attachment base of the chord playing attachment of FIG. 3.
Figure 5:
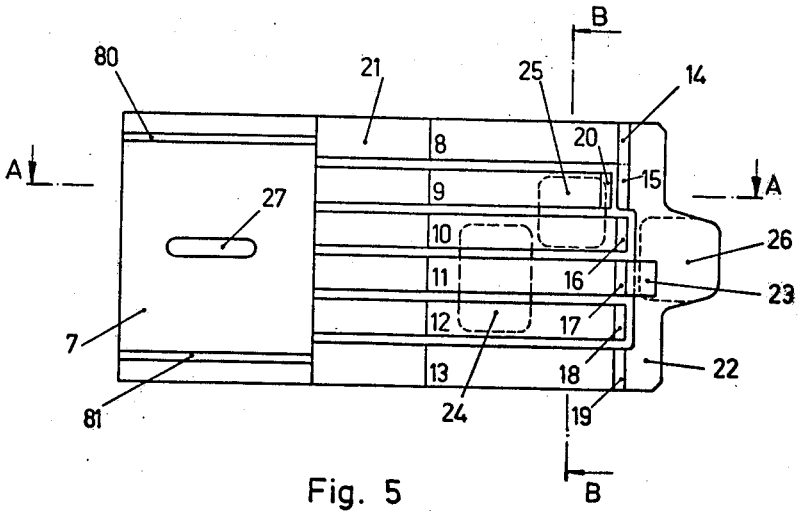
FIG. 5 is a bottom view of the slidable upper part without the attachment base of the embodiments of FIGS. 3, 8, 11, and 14.

With this modified embodiment, FIG. 4 shows a bottom view of the attachment base, FIG. 5 a bottom view of the slidable upper part without the attachment base, and FIG. 3 a cross-section along the line A — A through these respective parts when they are fastened together. The positions of the strings has not been shown, but their locations correspond to those of the spring levers 8–13. The location of the frets is denoted by the triangles I, II, and III in FIG. 3.

The pressure pads 2 and 3 on the bottom of the capo dastro plate 1 hold down the E, A, b, and e′ strings at the first fret position and the pressure pad 4 holds down the d and g strings at the second fret position. The two slits 5 and 6 serve as a means of fastening the device to the instrument. The top plate 7 carries the spring levers 8, 9, 10, 11, 12 and 13 with their associated string depressors 14, 16, 17, 18, 19 and 20. Muting pads 33 made from an elastic substance are fastened to the string depressors. The regions 21 of the spring levers are shaped into flat springs. The levers 8 and 13 are connected to one another by means of a bridge piece 22 which carries the string depressors 15 which form a double unit together with 14. The spring lever 11 carries an extension piece 23 which is long enough to reach under the bridge piece 22, so that when the finger key 26 is pressed down this spring lever will be pressed down as well. The finger keys 24, 25 and 26 are fastened to the spring levers 12 and 9 and the bridge piece 22, respectively. The top plate 7 is slidably fastened onto the attachment base 1 by means of a screw 28 or equivalent structure which passes through slit 27 and is tightened with a knurled nut 29 on the other side. A parallel back and forth motion of the plate 7 is ensured by the guiding grooves 80 and 81 which engage into corresponding tracks (not particularly shown in FIGS. 3 and 4) on the attachment base. If a resilient supporting pad 90 is placed between the top plate 7 and the attachment base 1 the height of the string depressors over the strings can be set by tightening or loosening the knurled nut 29. Depression of the finger key 24 produces a $B^{\flat}$ major chord, key 25 an F major chord and key 26 a $C^7$ chord. The two finger keys 24 and 25 also can be positioned in such a manner that key 25 (FIG. 5) lies to the left and key 24 lies to the right. This latter arrangement of the keys does not conform very well to the natural finger placement, but it does have the advantage that the neighboring keys 24 and 26 can be pressed down simultaneously with one finger and this enables chords to be produced which correspond to a barre fingering at the third fret position.

Model 3*a*

Figure 8:
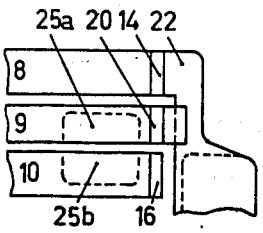
FIG. 8 is a fragmentary detail of embodiment 32.
Figure 9:
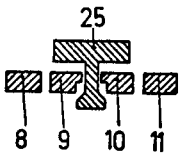
FIGS. 9 and 10 are respective cross-sectional views of different constructions of finger keys.

This model deviates from model 2 insofar as the spring lever 9 is constructed exactly the same as the spring lever 11, with the string depressor 20 assuming the function of string depressor 15 which now is omitted. The installation of the finger key 25 now has to be solved in a different way. It can be fastened by an extra spring mounted to the top plate, or, as shown in FIG. 9 (cross section B — B, FIG. 5 through the spring levers 8, 9, 10 and 11) it can be mounted so that it can slide perpendicularly between the spring levers 9 and 10. Model 3*a* could also be designed such that the finger key 25 is divided between the two spring levers 9 and 10 and the two key halves 25*a* and 25*b* are firmly attached to each such spring lever, as best seen by referring to FIG. 8. With this arrangement, both the keys can be pressed at the same time with one finger.

Figure 10:
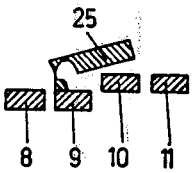

Another way to mount the finger key 25 would be to connect it to either one of the spring levers 9 or 10 with a hinge. FIG. 10 shows a cross section along the lines B—B of FIG. 5 of this arrangement where the two spring levers 8 and 9 have been pressed down.

Model 3*b*

Figure 14:
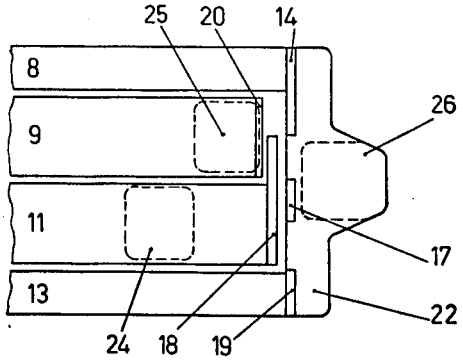
FIG. 14 is a fragmentary showing of embodiment 3*b* of the invention.

As best seen by referring to FIG. 14, model 2 also can be constructed such that the string depressor 17 is mounted upon the bridge piece 22. The previous function of the string depressor 17 together with the finger key 24 is then assumed by the lengthened string depressor 18. The two spring levers 11 and 12 (FIG. 5) can then be combined into just one single lever 11 (FIG. 14). This model can be even further modified along these lines by extending the string depressors 20 and 18 so that they take over the two functions of the spring depressor 16 (FIG. 5) and then combining the two levers 9 and 10 (FIG. 5) into one single lever 9 (FIG. 14).

Model 4

Figure 11:
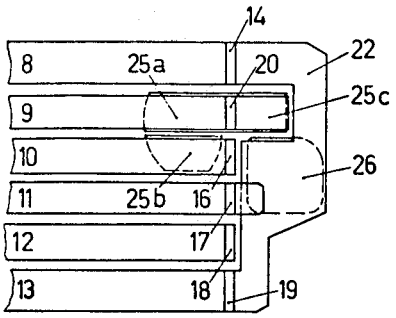
FIG. 11 illustrates a fourth modification of the chord playing attachment from that shown in FIG. 5.

This model is also a modification of model 2. FIG. 11 shows the parts which have been changed from those depicted in FIG. 5. As in model 3*a*, lever 9 has been lengthened; however the extension is not covered by the bridge piece 22 because a notch has been cut out of such bridge piece at this region. This enables a finger key 25*c* to be placed on the extension of the spring lever 9 and this key can be pressed together with key 26 using one finger. When key 26 is pressed alone, only the string depressors 14, 17 and 19 are pressed down. This model is somewhat harder to play than models 2 and 3, but it has the advantage of making it possible to produce additional chords with the extra fingers at the unused frets, e.g. an E♭ major or a g minor chord.

Model 5

This model is designed so that all the parts lie in one plane without bridging connections. Except for the muting pads on the string depressors, this model can be injection molded in a two-piece mold. This model also has a very low profile or construction which enables the fingers to be held in practically the same manner as they would be when playing an ordinary guitar without the chord playing attachment. The design of this model is evident from FIG. 6 which shows a bottom view. The location of the strings are indicated by the lines E, A, d, g, b, and e'; the position of the nut and the frets are denoted by the lines O, I, II, III and IV respectively. It will be seen that part of the attachment base 31 extends over the g string. The capo dastro pressure pads 32, 33 and 34 are made from an elastic material. The strings E, A, d, b, and e' in the first fret position and the g string in the second fret position are pressed down by these pads. The springs 35 and 36 carry the plate 37 with its associated finger key 38 and the string depressors 39, 40, 41 and 42 for an E♭ major chord. Spring 43 carries the plate 44 with its finger key 45 and the three-element string depressor 46 for a B♭ major chord. The spring 47 carries the plate 48 which is connected to the plate 50, which has the string depressors 51 and 52, by means of an additional spring 49. Pressing key 53 produces an $F^7$ chord, and pressing key 54 lifts the string depressor 52 from the string to give an F major chord. In a manner similar to models 2 and 6 this model can also be made in two pieces with a sliding upper part.

Model 6

Figure 7:
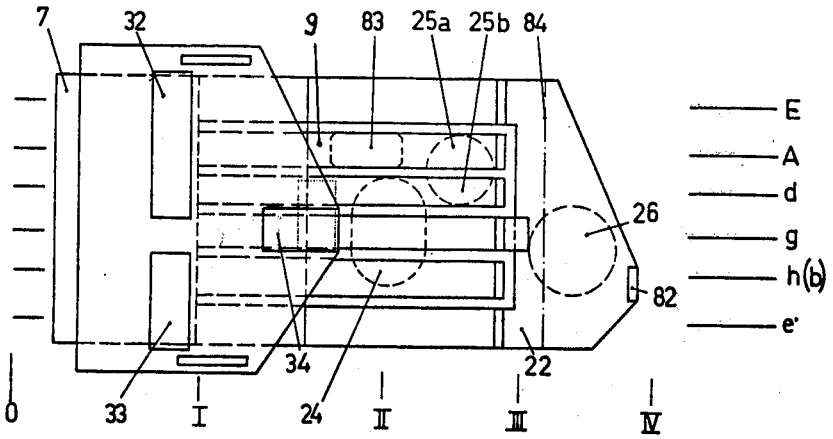
FIG. 7 illustrates a sixth embodiment of chord playing attachment.

This model is constructed similar to model 2. It encompasses the E♭ major, B♭ major, F major and $F^7$ chords. FIG. 7 shows a bottom view of the model with the attachment base in place. The function of the single parts will be readily understood through comparison with FIGS. 3, 4, 5, and 8.

Figure 6:
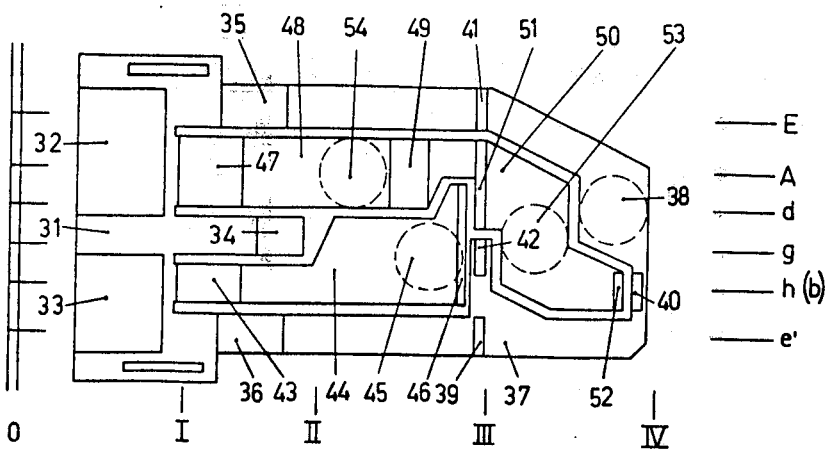
FIG. 6 is a bottom view of another a fifth embodiment of chord playing attachment.

It will be recognized that an additional spring depressor 82 is mounted onto bridge piece 22 and also an additional finger key 83 on spring lever 9. The capo dastro pressure pads are arranged in the same manner as in model 5 (FIG. 6).

Model 7

Figure 12:
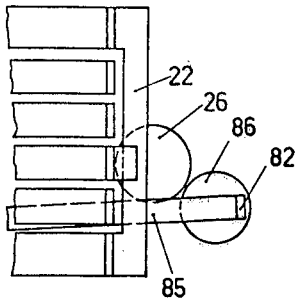
FIG. 12 is a fragmentary view of the sixth and seventh a modification of the invention.

This model differs from model 6 (FIG. 7) by the omission of the spring depressor 82. The bridge piece 22 now ends at the dotted line 84 (FIG. 7) and the key 26 is accordingly shifted to the left. The function of the spring depressor 82 is assumed by direct fingering of the b string in the 4th fret position. If the capo dastro pressure pad 34 is designed so that it can be swung out to the side (the position indicated by the dotted lines in FIG. 7) then this model can play any desired chord from the group E♭ major, B♭ major, F major, $F^7$ or the group B♭ major, F major, $C^7$. All the major keys can be accompanied with this model by sliding it along the first seven key positions of the guitar. An additional string depressor 82 can be added on to this model by means of a spring 85 (FIG. 12) which is connected either to the bridge piece 22 or the top plate 7. This string depressor 82 can be pressed down with its own special key 86 either alone or together with the finger key 26.

Model 8

Figure 13:
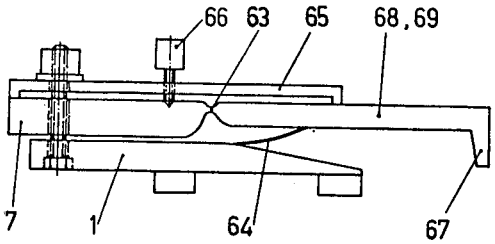
FIG. 13 is a side view of an eighth embodiment of the invention.

As shown in FIG. 13, still another embodiment is possible by attaching the levers 68 or plates 69 to the top plate 7 with joints or hinges 63 and to support them with restoring springs 64. The position of the spring levers or plates can be limited in their raised positions by means of a stop 65 whose position may be adjusted with the screw 66, thereby making it possible to set the distance between the string depressors 67 and the strings to an optimum value.

It is possible to use the features of model 8 in any one of the previously described models 1 to 7.

While there are shown and described present preferred embodiments of the invention, it is to be distinctly understood that the invention is not limited thereto, but may be otherwise variously embodied and practiced within the scope of the following claims. Accordingly,

What I claim is:

1. A chord playing attachment adapted to be attached to the neck of a stringed musical instrument such as a guitar or the like, comprising:

base means having at least one capo dastro pad secured thereto;

a top plate slidably secured to said base means, said top plate having integrally formed therewith a plurality of substantially parallel spring levers adapted to extend from said top plate in substantial alignment with the strings of said instrument;

a bridge element integrally joining the two outermost spring levers; and a plurality of string depressors, one attached to at least one of said spring levers, said string depressors being spaced from said top plate at preselected distances such that depression of each spring lever will depress associated strings at positions on said neck corresponding to the fingering of a preselected chord.

2. A chord playing attachment as defined in claim 1, further comprising:

a plurality of finger keys, one connected to said bridge element and at least one other connected to one of the inner spring levers.

3. The chord playing attachment as defined in claim 2, wherein:

said base means has adjustable means for attaching said base means at the neck of the guitar and the capo dastro pad on a lowest key position presses down the strings of the guitar in a first key position, so that depression of one to two finger keys or one finger key together with direct fingering of a selected string will produce at least three consecutive chords from the series D♭, A♭, E♭, B♭, F, C, and the last chord of the three consecutive chords can be replaced with its seventh chord.

4. The chord playing attachment as defined in claim 3, wherein:

said attachment is structured such that at least three consecutive chords from the series $E^{\flat}$, $B^{\flat}$, F, C, are produced and the last chord of the three consecutive chords can be replaced with its seventh chord.

5. The chord playing attachment as defined in claim 4, wherein:

said chord playing attachment is structured such that at least the three chords $B^{\flat}$, F, and $C^7$ are produced.

* * * * *